US007918580B2

(12) United States Patent
Liu

(10) Patent No.: US 7,918,580 B2
(45) Date of Patent: Apr. 5, 2011

(54) LED ILLUMINATION DEVICE

(75) Inventor: Tay-Jian Liu, Taipei Hsien (TW)

(73) Assignee: Foxconn Technology Co., Ltd., Tu-Cheng, New Taipei (TW)

( * ) Notice: Subject to any disclaimer, the term of this patent is extended or adjusted under 35 U.S.C. 154(b) by 118 days.

(21) Appl. No.: 12/467,310

(22) Filed: May 18, 2009

(65) Prior Publication Data

US 2009/0323342 A1 Dec. 31, 2009

(30) Foreign Application Priority Data

Jun. 27, 2008 (CN) ..... 2008 1 0068080

(51) Int. Cl.
*F21V 7/20* (2006.01)

(52) U.S. Cl. ..... 362/218; 362/217.1; 362/217.08; 362/249.02

(58) Field of Classification Search ..... 362/294, 362/373, 147, 148, 217.1, 218, 249.02, 217.6
See application file for complete search history.

(56) References Cited

U.S. PATENT DOCUMENTS

| | | | | |
|---|---|---|---|---|
| 6,472,996 | B1 * | 10/2002 | Pederson | 340/815.45 |
| 7,594,738 | B1 * | 9/2009 | Lin et al. | 362/249.02 |
| 7,637,638 | B2 * | 12/2009 | Chen | 362/294 |
| 7,771,090 | B2 * | 8/2010 | Chang et al. | 362/294 |
| 7,815,338 | B2 * | 10/2010 | Siemiet et al. | 362/218 |

FOREIGN PATENT DOCUMENTS

| | | | |
|---|---|---|---|
| CN | 201007462 | Y | 1/2008 |
| CN | 101118883 | A | 2/2008 |
| CN | 201041338 | Y | 3/2008 |

* cited by examiner

*Primary Examiner* — Ali Alavi
(74) *Attorney, Agent, or Firm* — Frank R. Niranjan

(57) ABSTRACT

An LED illumination device includes a light source and a heat sink. The heat sink includes an elongated base and a plurality of fins extending from the base. The base has a heat-absorbing surface and an opposite heat-spreading surface. The fins extend upwardly from the heat-spreading surface. The light source is attached to the heat-absorbing surface, whereby heat generated by the light source is removed by the heat sink. The heat-absorbing surface is one of a convex surface and a concave surface, whereby light emitted from the light source is diverged or converged towards objects.

10 Claims, 9 Drawing Sheets

LED ILLUMINATION DEVICE

CROSS-REFERENCE TO RELATED APPLICATION

This application is related to a co-pending U.S. patent application Ser. No. 12/423,020 filed on Apr. 14, 2009 and entitled "LED ILLUMINATION DEVICE AND LIGHT ENGINE THEREOF". The co-pending U.S. patent application is assigned to the same assignee as the instant application. The disclosure of the above-identified application is incorporated herein by reference.

BACKGROUND

1. Technical Field

The present disclosure relates to an LED illumination device.

2. Description of Related Art

In recent years, LEDs are preferred for use in illumination devices rather than CCFLs (cold cathode fluorescent lamps) due to their excellent properties, including high brightness, long lifespan, wide color range, and etc.

For an LED, about eighty percents of the power consumed thereby is converted into heat. Therefore, a heat dissipation device is necessary for timely and adequately removing the heat generated by the LED. Generally, the illumination device includes a plurality of LEDs and the LEDs are arranged on a flat surface whereby an illumination area of the LEDs is limited. Thus, the illumination device cannot obtain a desired illumination area.

For the foregoing reasons, therefore, there is a need in the art for an LED illumination device which overcomes the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
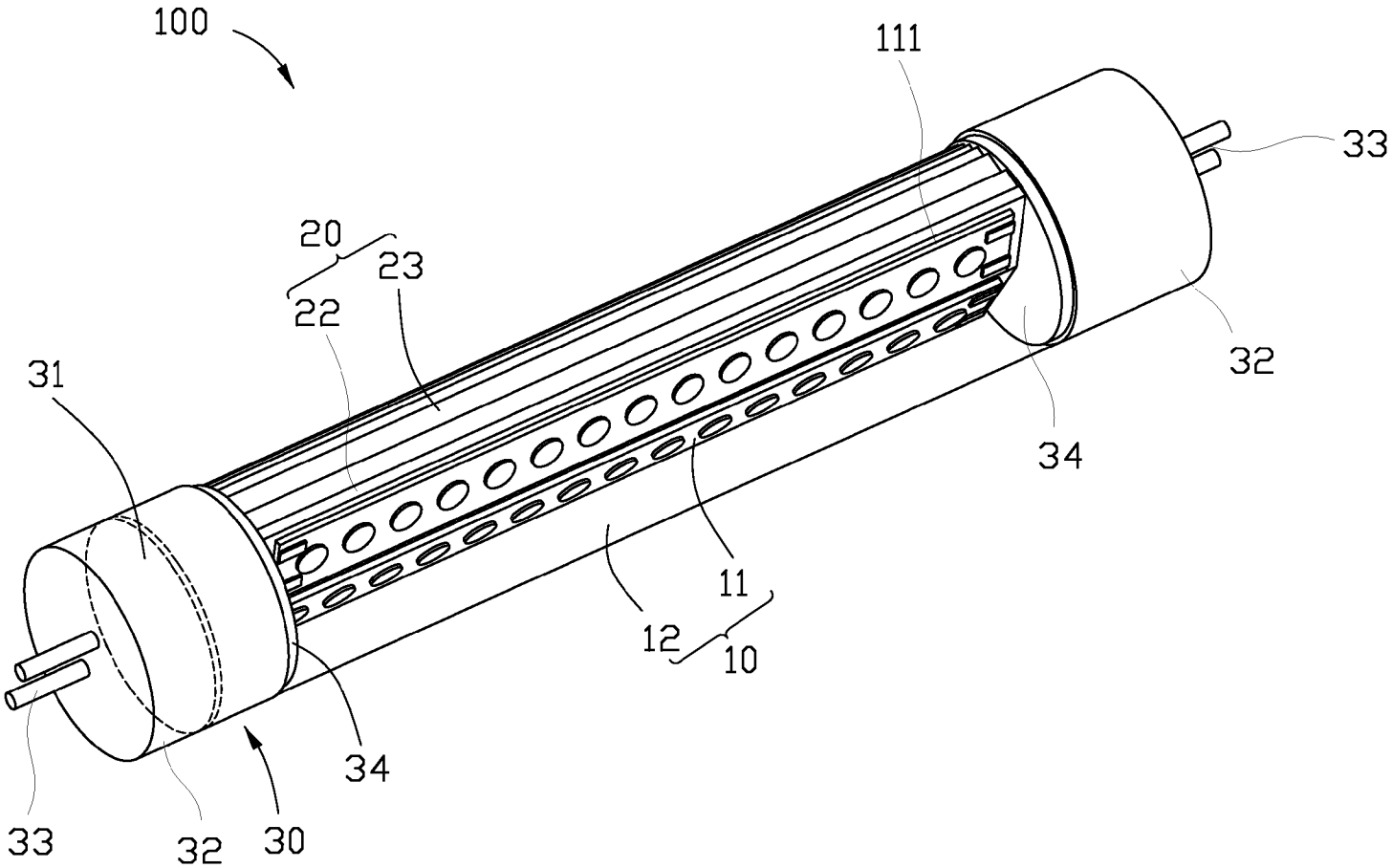
FIG. 1 is an isometric, assembled view of an LED illumination device according to an exemplary embodiment.
Figure 2:
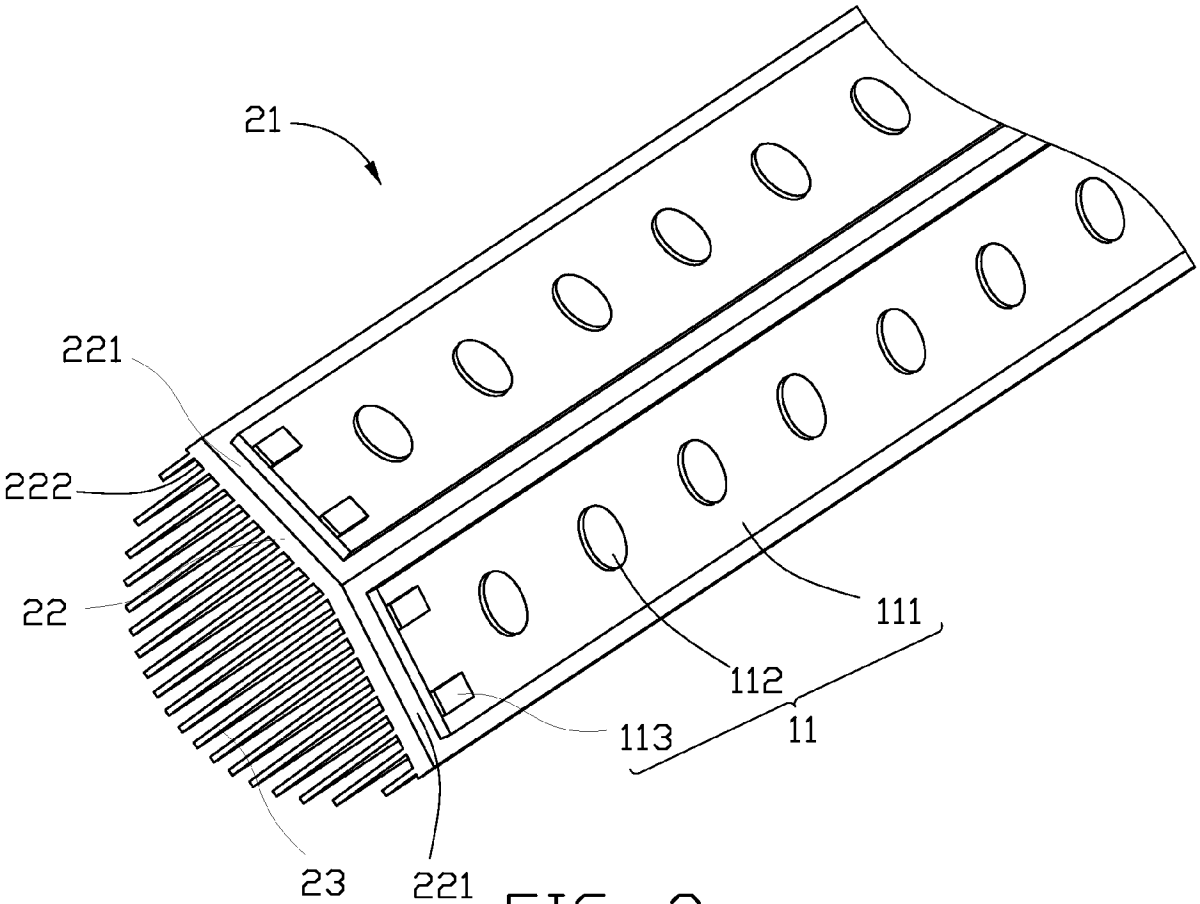
FIG. 2 is an isometric view showing a portion of a light engine of the LED illumination device of FIG. 1.
Figure 3:
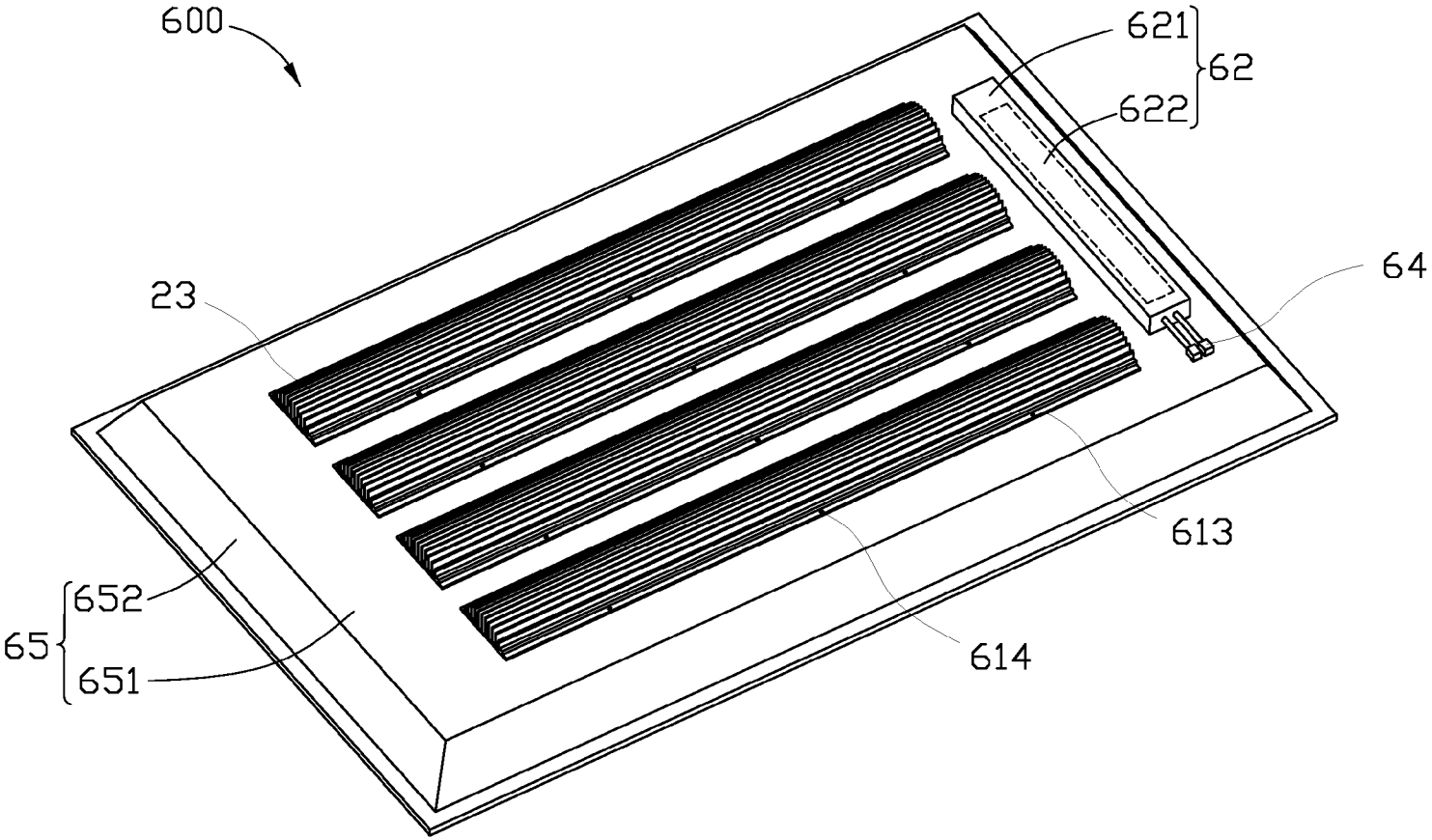
FIG. 3 is an isometric, assembled view of an LED illumination device according to an alternative embodiment.
Figure 4:
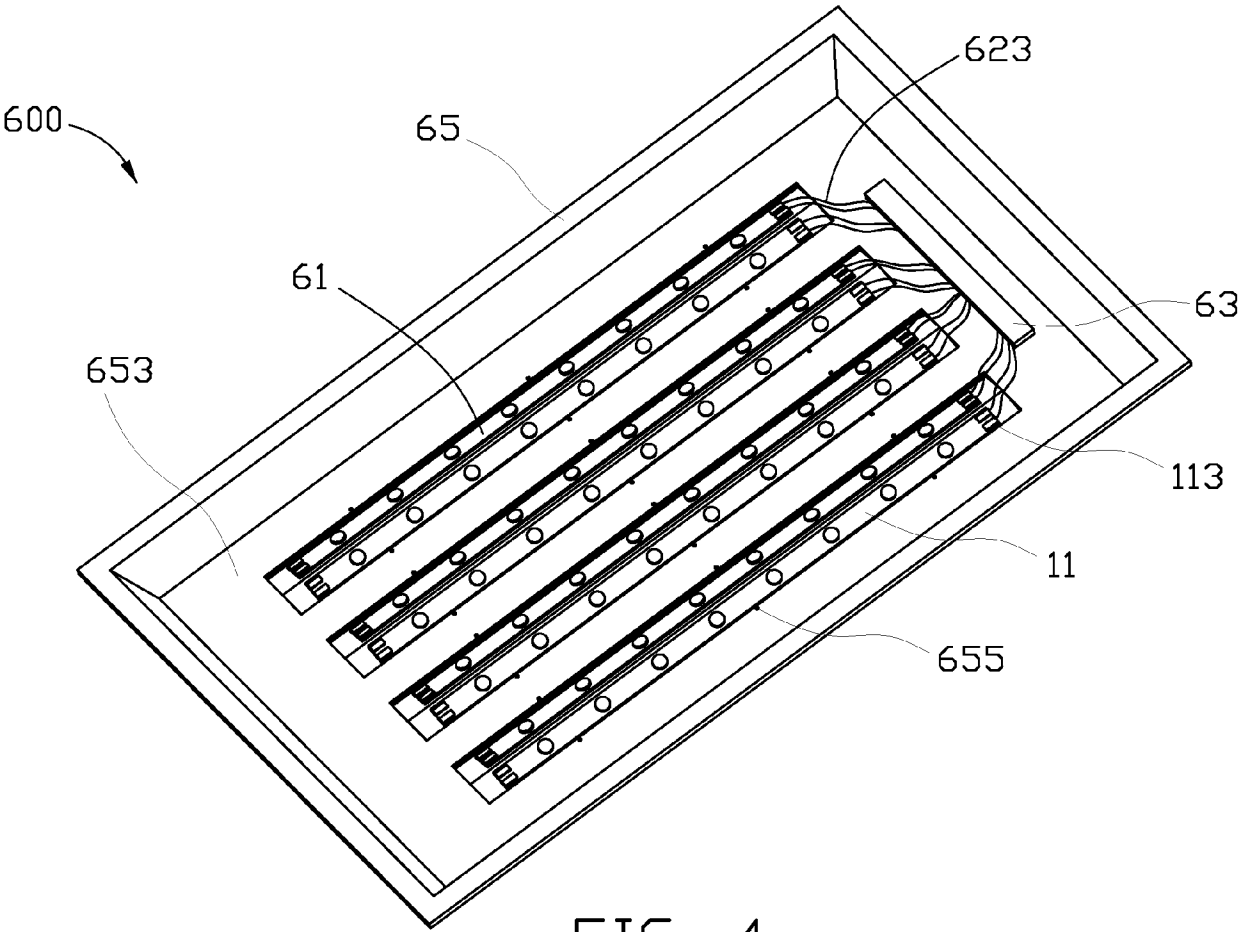
FIG. 4 shows the LED illumination device of FIG. 3, but viewed from another viewpoint.
Figure 5:
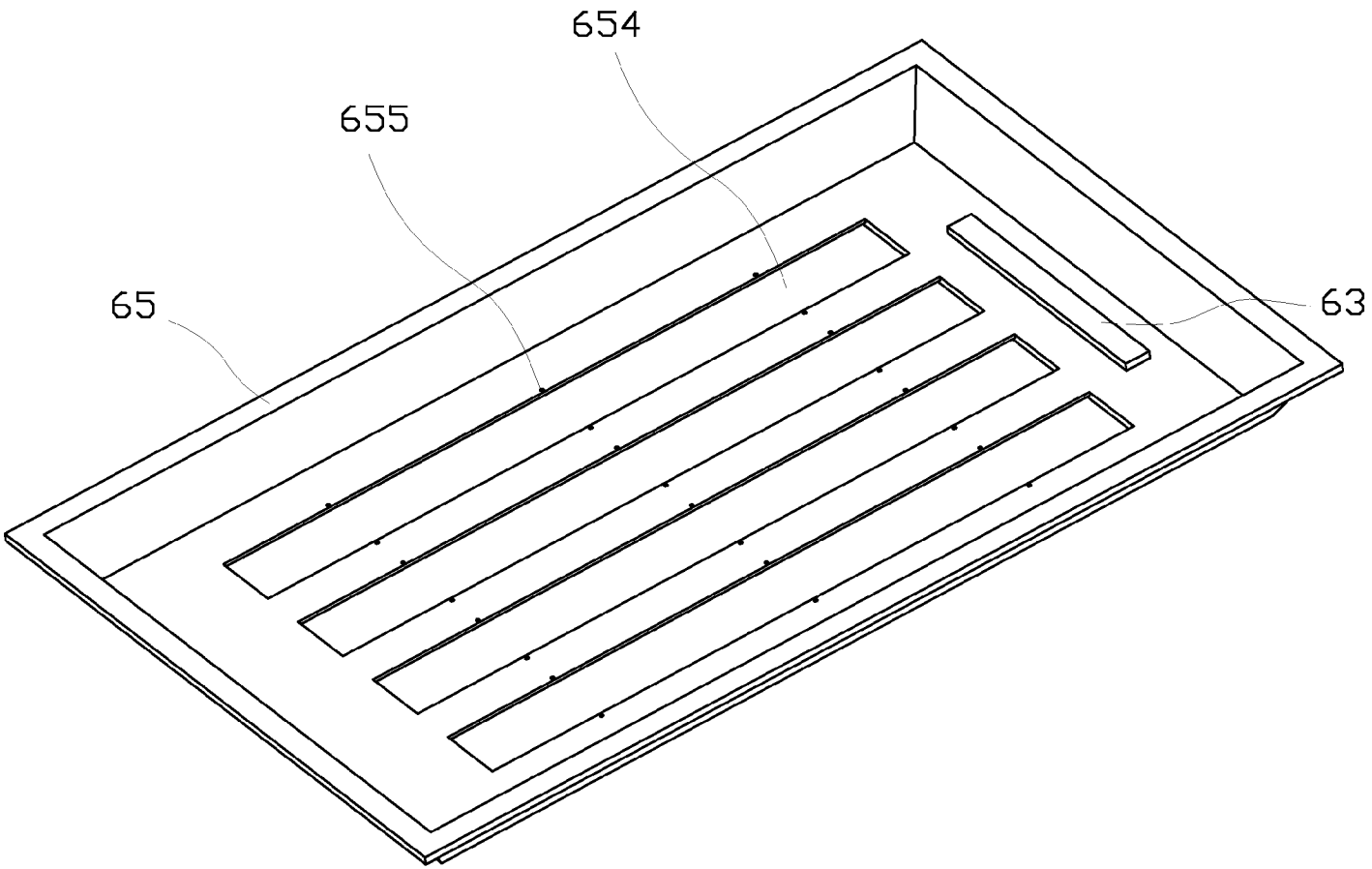
FIG. 5 is an isometric view of a lampshade of the LED illumination device of FIG. 3.

Referring to FIGS. 1 and 2, an LED illumination device 100 according to an exemplary embodiment includes a light-emitting module 10, a heat sink 20 arranged above the light-emitting module 10, and an electrical module 30 electrically connected with the light-emitting module 10.

The heat sink 20 includes an elongated metal base 22 and a plurality of metal fins 23 extending from the base 22. The base 22 is substantially V-shaped, and has a convex surface 221 and an opposite concave surface 222. Each of the convex surface 221 and the concave surface 222 is constructed by two intersecting flat surface portions. The fins 23 extend vertically upwardly from the concave surface 222 of the base 22, and are arranged symmetric to a joint of the two surface portions of the concave surface 222. A height of the fins 23 decreases from the joint of the concave surface 222 towards two opposite lateral sides of the base 22. Upper free ends of the fins 23 cooperatively form an imaginary convex surface. In other words, the fins 23 at the joint of the concave surface 222 of the base 22 have a maximum height, and the fins 23 at the lateral sides of the base 22 have a minimum height. Thus, a heat dissipation at a center of the heat sink 20 is enhanced.

The light-emitting module 10 includes a light source 11 and an optical lens 12 in front of the light source 11. Light emitted by the light source 11 is guided to environment by the optical lens 12. The light source 11 is attached to the convex surface 221 of the base 22 of the heat sink 20. The heat sink 20 and the light source 11 are assembled together to form a light engine 21 for the LED illumination device 100. The convex surface 221 of the base 22 functions as a heat-absorbing surface for the light source 11, and the concave surface 222 of the base 22 functions as a heat-spreading surface for the light source 11.

The light source 11 includes a pair of light bars. Each light bar includes an elongated substrate 111 and a plurality of LEDs 112 arranged on the substrate 111. A pair of electrodes 113 are provided at two opposite ends of the substrate 111. The LEDs 112 are evenly spaced from each other along the substrate 111, and are electrically connected to the electrodes 113. A layer of thermal interface material (TIM) may be applied between the substrate 111 and the convex surface 221 of the base 22 to eliminate an air interstice therebetween, to thereby enhance a heat conduction efficiency between the base 22 and the substrate 111. Alternatively, the substrate 111 can be attached to the convex surface 221 of the base 22 fixedly and intimately through surface mount technology (SMT).

The electrical module 30, which provides drive power, control circuit and power management for the light source 11, includes a circuit board 31, two protecting covers 32, and two pairs of electrical pins 33. The two protecting covers 32 are arranged at two opposite ends of the heat sink 20. Each protecting cover 32 is connected with one pair of the electrical pins 33. Each protecting cover 32 is isolated from the heat sink 20 by a partition plate 34. The partition plate 34 is made of a metal and isolates the circuit board 31 from the heat sink 20. The heat sink 20 is located between the two protecting covers 32.

During operation, the electrodes 113 of the light source 11 are electrically connected to the circuit board 31, whereby an external power source can supply electric current to the LEDs 112 through the circuit board 31 to cause the LEDs 112 to emit light. The light of the LEDs 112 travels through the optical lens 12 to outside for lighting. In use, a large amount of heat is generated by the LEDs 112 of the LED illumination device 100. As the light source 11 is attached to the heat sink 20, the heat generated by the LEDs 112 can be conducted to the heat sink 20 for dissipation. The heat of the LEDs 112 is removed timely and effectively by the heat sink 20. Thus, the LEDs 112 can be kept working at a lower temperature, and the brightness, lifespan, and reliability of the LED illumination device 100 will be improved. At the same time, as the light source 11 is attached to the convex surface 221 of the heat sink 20, the light engine 21 is constructed as a diverging type light engine wherein light emitted from the LEDs 112 diverges outwardly towards objects, so that the light engine 21 can illuminate a desired large area.

Referring to FIGS. 3-6, an LED illumination device 600 according to an alternative embodiment includes a lampshade 65 and a plurality of light engines 61 mounted on the lampshade 65. The plurality of light engines 61 are identical to each other, and are arranged parallel to each other. Each light engine 61 includes the light source 11 and a heat sink 20*a* for dissipating heat of the light source 11.

The lampshade 65 includes a top mounting plate 651 and a sidewall 652 extending downwardly from a periphery of the mounting plate 651. The mounting plate 651 is substantially rectangular. The sidewall 652 expands slightly outwardly from the periphery of the mounting plate 651. The lampshade 65 defines a recess 653 therein for accommodating the light sources 11 therein. The recess 653 is surrounded by the sidewall 652 and the mounting plate 651. A plurality of elongated openings 654 are defined in the mounting plate 651 for mounting the light engines 61 on the mounting plate 651. The openings 654 are parallel to and spaced from each other, and communicate with the recess 653. A plurality of mounting holes 655 are defined in the mounting plate 651 at two opposite lateral sides of each opening 654 for mounting a corresponding light engine 61 to the mounting plate 651.

A wire box 63 is mounted on an inner surface the mounting plate 651 and is received in the recess 653. An electrical module 62 is mounted on an outer surface of the mounting plate 651. The electrical module 62 includes a protecting cover 621 and a circuit board 622 received in the protecting cover 621. The protecting cover 621 protects the circuit board 622 from an outer environment. The protecting cover 621 and the wire box 63 are located at one end of the mounting plate 651. Each light source 11 is electrically connected with the circuit board 622 via electrical wires 623. The electrical wires 623 of the light sources 11 are together connected to the wire box 63 and then electrically connected with the circuit board 622. A plug 64 extends outwardly from the protecting cover 621 for connecting the circuit board 622 to an external power source. Cooperatively, the wire box 63 and the electrical module 62 provide drive power, control circuit and power management for the light sources 11 of the LED illumination device 600.

Figure 6:
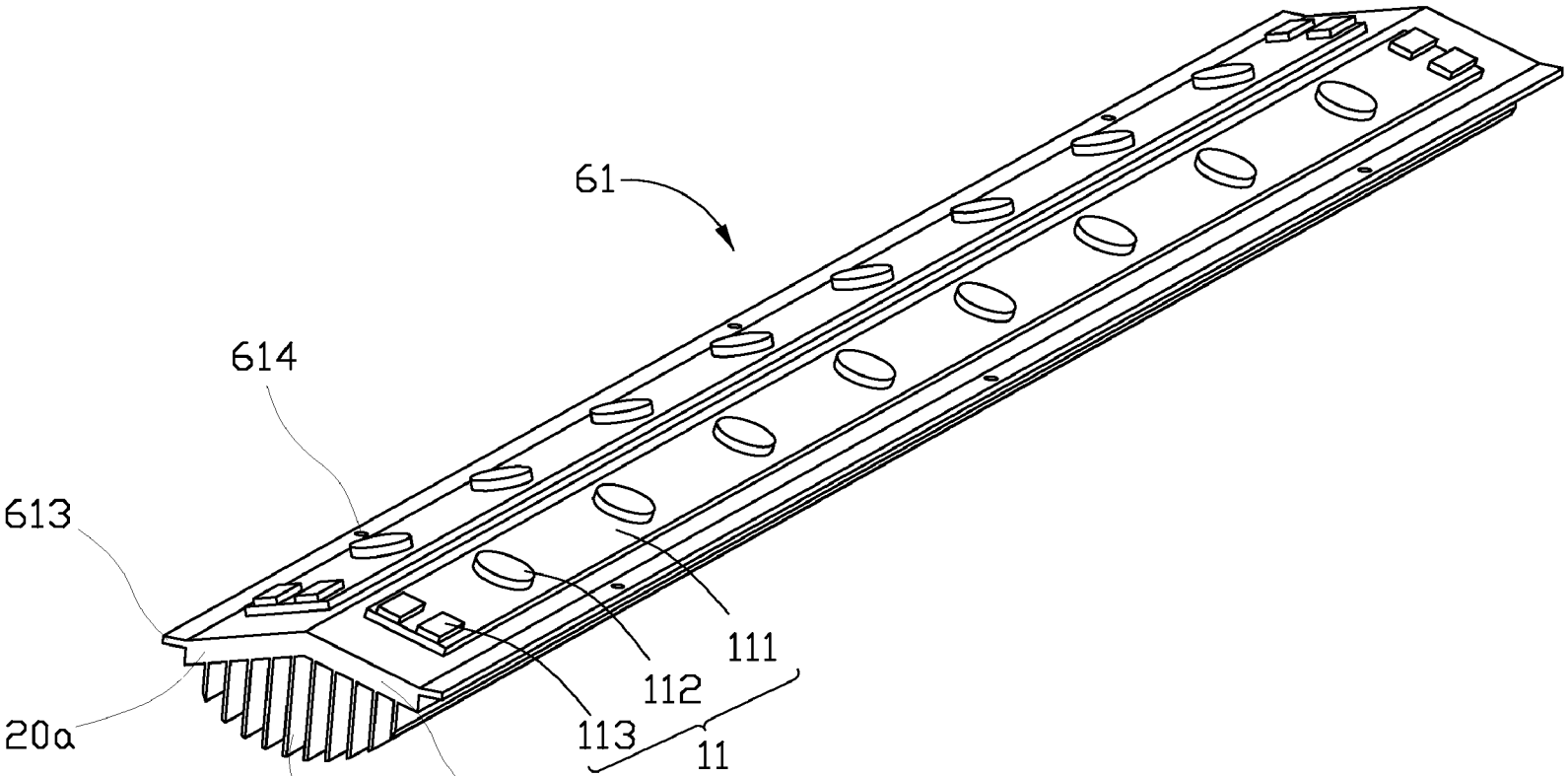
FIG. 6 is an isometric view showing a light engine of the LED illumination device of FIG. 3.

The heat sink 20*a* shown in FIG. 6 is the same as the heat sink 20 shown in FIG. 2 except for the following difference. A pair of mounting flanges 613 extends horizontally and outwardly from two opposite lateral sides of the base 22, respectively. The mounting flanges 613 define a plurality of mounting apertures 614 therein, corresponding to the mounting holes 655 of the mounting plate 651. A size of the base 22 is substantially the same as that of the opening 654 of the mounting plate 651.

When assembled, fixing devices, such as screws, extend through the mounting apertures 614 of the heat sink 20*a* and the mounting holes 655 of the mounting plate 651 to assemble the light engines 61 in the corresponding openings 654 of the lampshade 65 to form the LED illumination device 600. The light source 11 of each light engine 61 is received in the recess 653 of the lampshade 65, the base 22 of the heat sink 20*a* is located in the opening 654 with the mounting flanges 613 of the heat sink 20*a* abutting against the mounting plate 651 beside the opening 654, and the fins 23 of the heat sink 20*a* extend from the opening 654 to an outside of the lampshade 65.

During operation, the electrodes 113 of the light sources 11 are connected to the wire box 63 through the wires 623, whereby the external power source can supply electric current to the LEDs 112 through the circuit board 622 and the wire box 63 to cause the LEDs 112 to emit light. The light of the LEDs 112 travels along the lampshade 65 to outside for lighting. In addition, a large amount of heat is generated during operation of the LED illumination device 600. The heat of the LEDs 112 is removed timely and effectively by the heat sink 20*a*. The light engine 61 is constructed as a diverging type light engine wherein light emitted from the LEDs 112 diverges outwardly towards objects, so that the light engine 61 can illuminate a desired large area.

Figure 7:
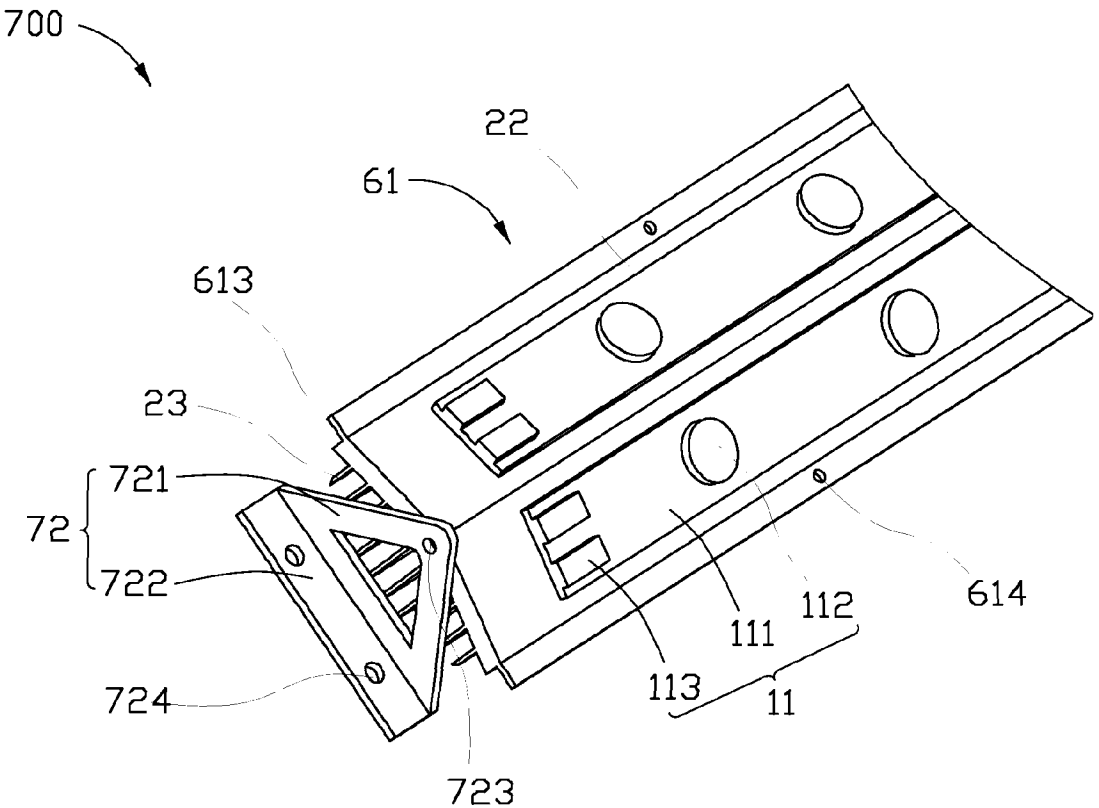
FIG. 7 is an isometric, assembled view showing an portion of an LED illumination device according to another alternative embodiment.

Referring to FIG. 7, an LED illumination device 700 according to another alternative embodiment includes the light engine 61 of FIG. 6 and a pair of mounting brackets 72 (only one shown) arranged at two opposite longitudinal ends of the light engine 61. Each mounting bracket 72 includes a triangular-shaped supporting plate 721 and a mounting flange 722 extending horizontally outwardly from a bottom side of the supporting plate 721. A first mounting hole 723 is defined at a top side of the supporting plate 721 for mounting the mounting bracket 72 to the light engine 61. A pair of second mounting holes 724 is defined in the mounting flange 722 for mounting the LED illumination device 700 onto a supporting piece such as a wall or a ceiling.

Figure 8:
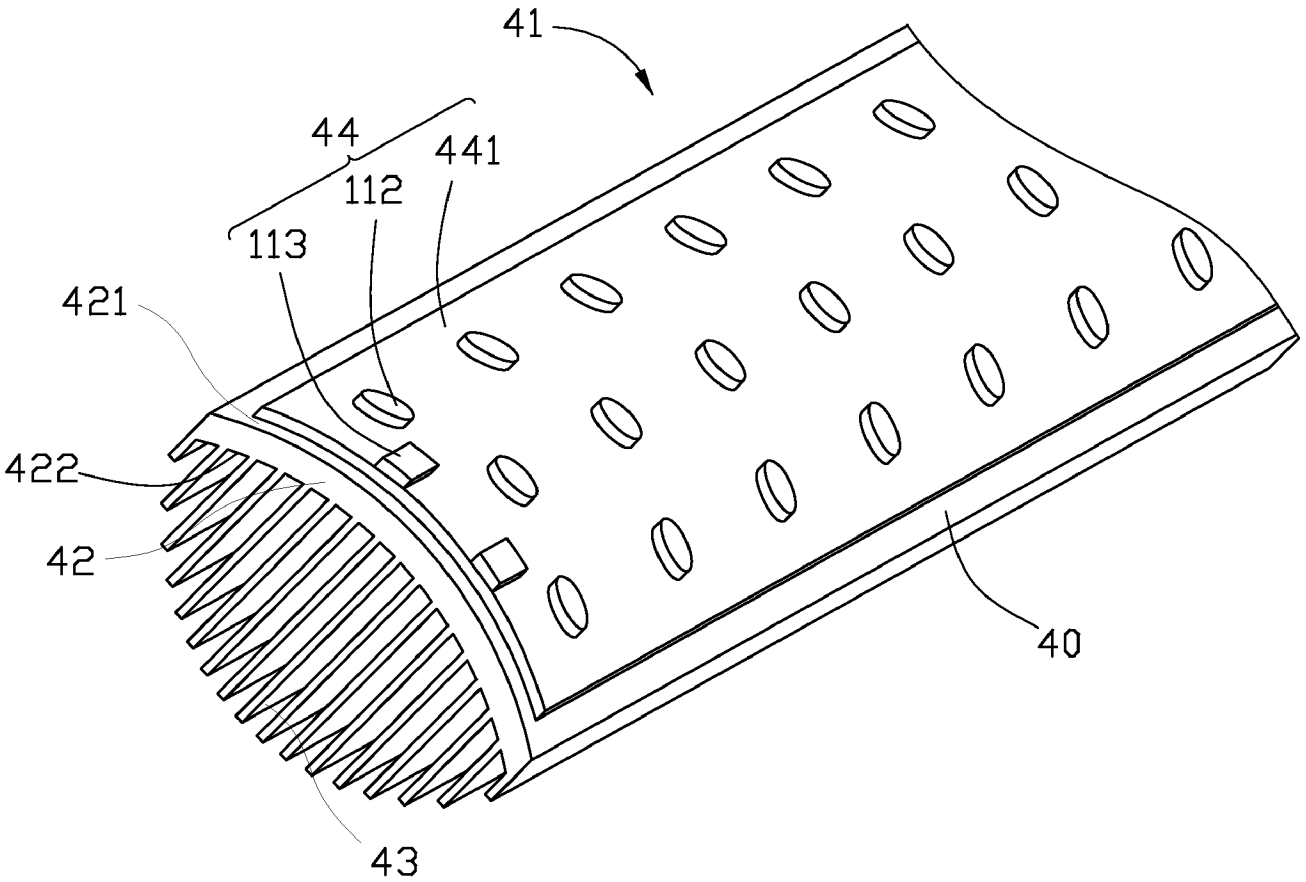
FIG. 8 is an isometric view showing a portion of a light engine according to a further alternative embodiment.

FIG. 8 shows an alternative light engine 41 including a heat sink 40 and a light source 44 mounted on the heat sink 40. The heat sink 40 includes an elongated, arc-shaped metal base 42 and a plurality of metal fins 43 extending from the base 42. The base 42 has a convex surface 421 and a concave surface 422 opposite to the convex surface 421. The fins 43 extend upwardly from the concave surface 422 of the base 42. The light source 44 is attached to the convex surface 421 of the base 42. The light source 44 includes an elongated, arc-shaped substrate 441, which in accordance with the preferred embodiment is a flexible printed circuit board, a plurality of LEDs 112 mounted on the substrate 441, and a pair of electrodes 113 formed at one end of the substrate 441. The arc-shaped substrate 441 is matched with the convex surface 421 of the base 42. The convex surface 421 of the base 22 functions as a heat-absorbing surface for the light source 44, and the concave surface 422 of the base 42 functions as a heat-spreading surface for the light source 44. The light engine 41 is constructed as a diverging type light engine wherein light emitted from the LEDs 112 diverges outwardly towards objects, so that the light engine 41 can illuminate a desired large area.

Figure 9:
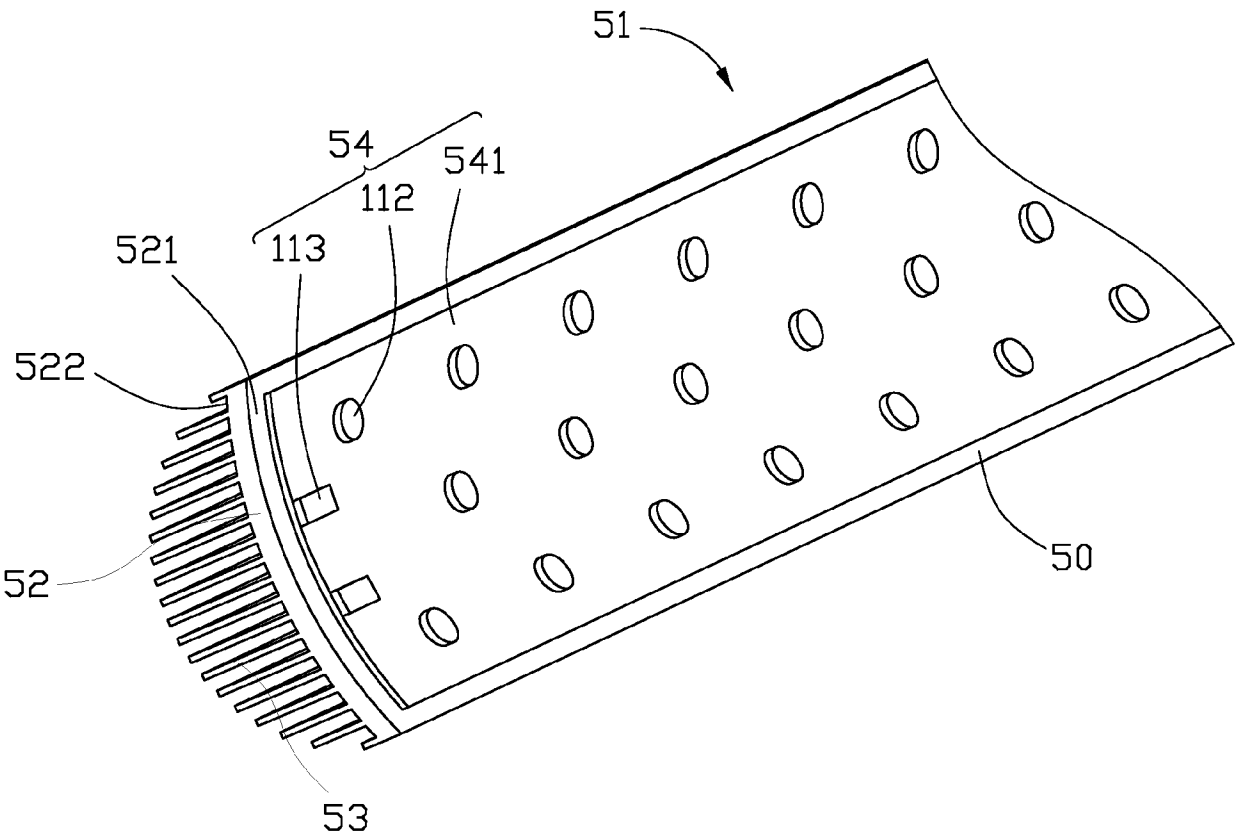
FIG. 9 is an isometric view showing a portion of a light engine according to a yet another alternative embodiment.

Referring to FIG. 9, a light engine 51 according to a further alternative embodiment includes a heat sink 50 and a light source 54 mounted on the heat sink 50. The heat sink 50 includes an elongated, arc-shaped metal base 52 and a plurality of metal fins 53 extending from the base 52. The base 52 has a concave surface 521 and a convex surface 522 opposite to the concave surface 521. The fins 53 extend upwardly from the convex surface 522 of the base 52. The light source 54 is attached to the concave surface 521 of the base 52. The light source 54 includes an elongated, arc-shaped substrate 541, which in accordance with the preferred embodiment is a flexible printed circuit board, a plurality of LEDs 112 mounted on the substrate 541, and a pair of electrodes 113 formed at one end of the substrate 541. The arc-shaped substrate 541 is matched with the concave surface 521 of the base 52. The concave surface 521 of the base 52 functions as a heat-absorbing surface for the light source 54, and the convex surface 522 of the base 52 functions as a heat-spreading surface for the light source 54. The light engine 51 is constructed as a converging type light engine wherein light emitted from the LEDs 112 converges inwardly towards objects, so that the light engine 51 can collectively illuminate a desired small area.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED illumination device, comprising:

a light source;

a heat sink comprising an elongated base and a plurality of fins extending from the base, the base having a heat-absorbing surface and an opposite heat-spreading surface, the fins extending upwardly from the heat-spreading surface, the light source being attached to the heat-absorbing surface, the heat-absorbing surface being one of a convex surface and a concave surface; and two protecting covers arranged at two opposite ends of the heat sink, each of the two protecting covers being connected with one pair of electrical pins, a circuit board being received in one of the two protecting covers.

2. The LED illumination device of claim 1, wherein a height of the fins decreases from a center towards two opposite lateral sides of the base, and upper free ends of the fins cooperatively form an imaginary convex surface.

3. The LED illumination device of claim 1, wherein the base of the heat sink is substantially arc-shaped, the heat-absorbing surface of the base being a convex surface, the heat-spreading surface of the base being a concave surface.

4. The LED illumination device of claim 3, wherein the light source comprises an arc-shaped, elongated substrate and a plurality of LEDs mounted on the substrate, the substrate being mounted on the heat-absorbing surface of the base.

5. The LED illumination device of claim 4, wherein the substrate is a flexible printed circuit board.

6. The LED illumination device of claim 1, wherein the base of the heat sink is substantially V-shaped, the heat-absorbing surface of the base being a convex surface, the heat-spreading surface of the base being a concave surface.

7. The LED illumination device of claim 6, wherein the light source comprises a plurality of light bars, each light bar comprising an elongated substrate and a plurality of LEDs mounted on the substrate, the substrate being mounted on the heat-absorbing surface of the base.

8. The LED illumination device of claim 1, wherein the base of the heat sink is substantially arc-shaped, the heat-absorbing surface of the base being a concave surface, the heat-spreading surface of the base being a convex surface.

9. The LED illumination device of claim 8, wherein the light source comprises an arc-shaped, elongated substrate and a plurality of LEDs mounted on the substrate, the substrate being mounted on the heat-absorbing surface of the base.

10. The LED illumination device of claim 9, wherein the substrate is a flexible printed circuit board.

* * * * *